United States Patent [19]

Wang

[11] Patent Number: 4,827,639

[45] Date of Patent: May 9, 1989

[54] ASSEMBLY FOR MOUNTING PHOTOGRAPHS

[76] Inventor: Thomas T. M. Wang, No. 1, Alley 10, Lane 22, Kuang Fu S Rd., Taipei, Taiwan

[21] Appl. No.: 38,616

[22] Filed: Apr. 15, 1987

[51] Int. Cl.[4] ..... A47G 1/06; G09F 1/12

[52] U.S. Cl. ..... 40/152.1; 40/611; 40/124

[58] Field of Search ..... 40/124.1, 152, 152.1, 40/611, 124.4, 124, 10 R, 11 R

[56] References Cited

U.S. PATENT DOCUMENTS

| | | | |
|---|---|---|---|
| 2,141,866 | 12/1938 | Hoffmann | 40/591 |
| 2,520,490 | 8/1950 | Boward | 40/124.4 |
| 2,655,330 | 10/1953 | Martinez | 40/152.1 |
| 3,525,493 | 8/1970 | Chrietzberg et al. | 40/11 R |
| 4,291,882 | 9/1981 | Del Monte | 40/10 R |
| 4,385,459 | 5/1983 | McGrath et al. | 40/124.1 |
| 4,669,733 | 6/1987 | Sweet | 40/124.4 |

*Primary Examiner*—Robert Peshock
*Assistant Examiner*—Michael Lynch
*Attorney, Agent, or Firm*—Bacon & Thomas

[57] ABSTRACT

Photographs are inserted within separate mounting frames which are, in turn, secured by their edges in corresponding channel-shaped grooves formed in a support which permits the frames to be displayed in a standing position. The grooves are provided with rubber blocks for engaging edge portions of the frames to prevent their inadvertent removal from the grooves.

2 Claims, 2 Drawing Sheets

ASSEMBLY FOR MOUNTING PHOTOGRAPHS

BACKGROUND OF THE INVENTION

1. Field of the Invention

The present invention generally involves the field of technology pertaining to photography. More specifically, the invention relates to an improved assembly through which photographs may be mounted for display.

2. Description of the Prior Art

It is known to provide a photograph frame assembly wherein a groove is provided for the direct insertion of a frame body. However, the frame body can easily slip out of the groove and cause damage to the frame body or an adjacent article, or even cause physical injury.

SUMMARY OF THE INVENTION

The present invention provides an improved assembly for mounting a photograph wherein a support is provided with channel-shaped grooves for receiving the edges of photograph frames, the latter being securely retained within the grooves by means of rubber blocks disposed within recesses in the side walls of the grooves for engaging the corresponding edge portions of the frames.

DETAILED DESCRIPTION OF THE PREFERRED EMBODIMENT

Figure 1:
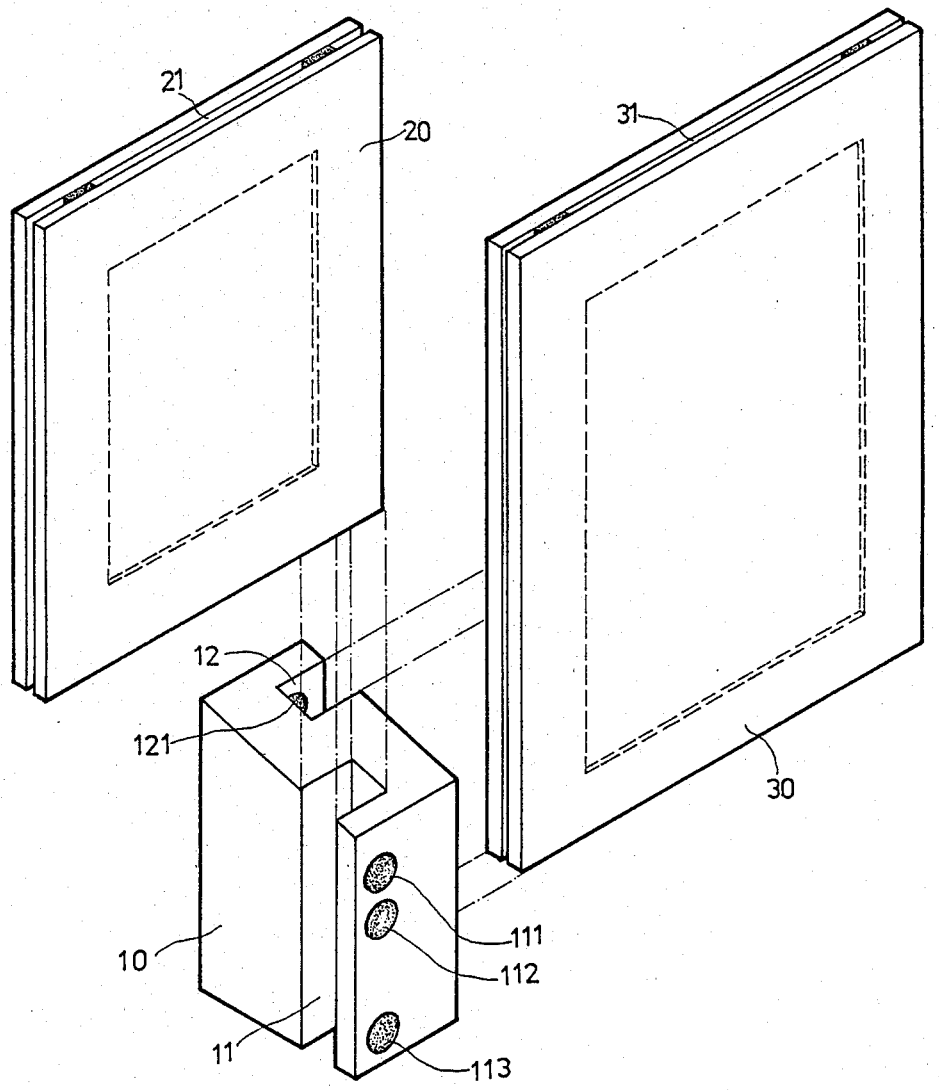
FIG. 1 is an exploded perspective view of an assembly for mounting photographs according to a preferred embodiment of the invention.
Figure 2:
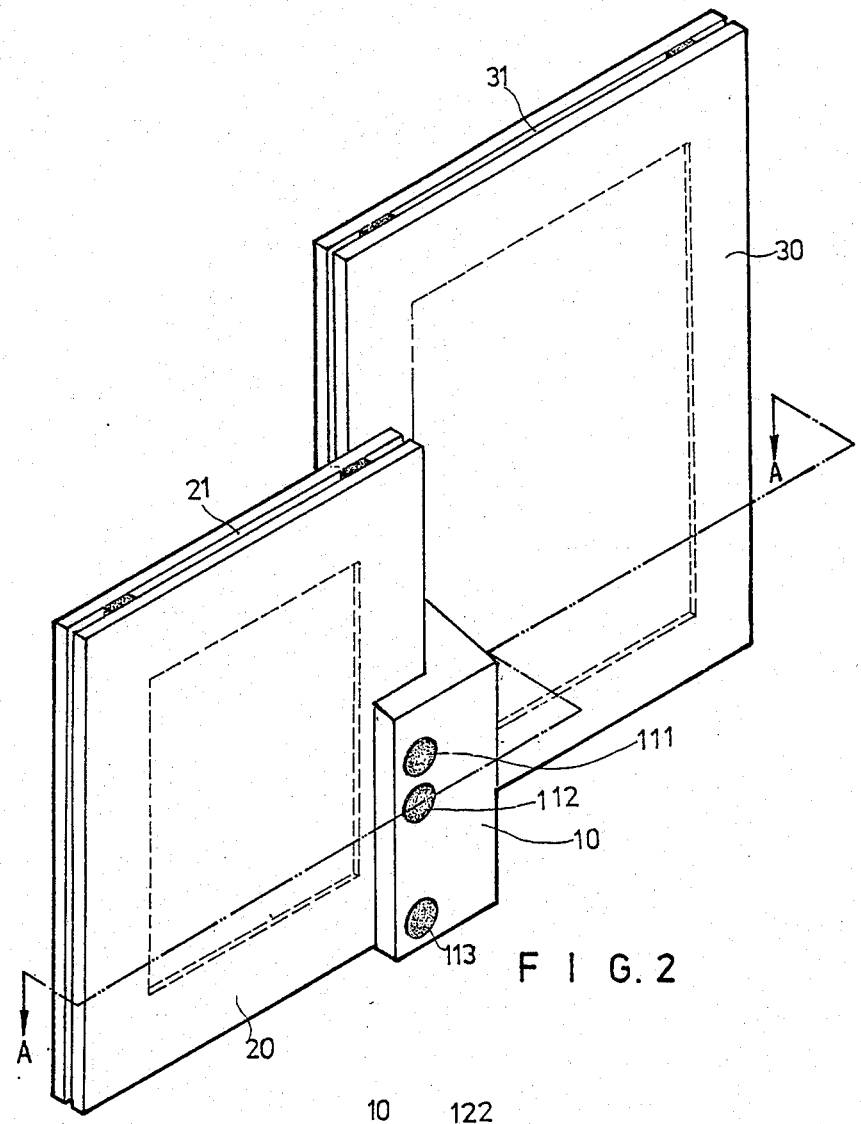
FIG. 2 is a perspective view of the assembly shown in FIG. 1 in its assembled form.

With initial reference to FIGS. 1 and 2, there is shown a preferred embodiment of the invention as comprising a mounting support 10 provided with a pair of oppositely directed channel-shaped mounting grooves 11 and 12. As also shown in FIG. 3, grooves 11 and 12 are provided with a plurality of convex rubber blocks

111, 112, 113, 121 and 122 disposed within recesses in the side walls thereof.

A pair of photograph frames 20 and 30, provided with respective slits 21 and 31 for receiving photographs therein, are engageable within grooves 11 and 12, respectively, of support 10, as shown in FIGS. 1 and 2. Rubber blocks 111, 112, 113, 121 and 122 are of such size and configuration that they protrude inwardly within grooves 11 and 12 to provide frictional engagement against the corresponding edges of frames 20 and 30, thereby securely retaining frames 20 and 30 within grooves 11 and 12 against their inadvertent removal. It is preferred that the dimensions and configurations of grooves 11 and 12, and also rubber blocks 111, 112, 113, 121 and 122 be such as to require frames 20 and 30 to be squeezed into their respective grooves 11 and 12.

Figure 3:
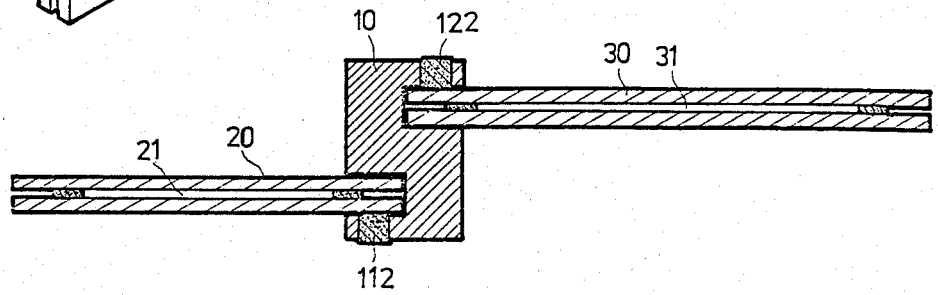
FIG. 3 is a cross-sectional view taken along the line and in the direction indicated at A—A in FIG. 2.

As apparent from FIG. 3, rubber blocks 112 and 122, as well as the remaining rubber blocks, are of rod-shaped configuration and disposed through apertures formed in the walls of grooves 11 and 12. It is further preferred that the opposed ends of each rubber block be slightly larger for firm engagement against their corresponding frames 20 and 30.

I claim:

1. An improved assembly for mounting photographs comprising:

(a) a mounting support provided with a pair of oppositely directed channel-shaped grooves, each groove including a side wall;

(b) a pair of rectangular-shaped frames for mounting photographs, each frame provided with an edge portion inserted within a corresponding groove;

(c) the side wall of each groove including means frictionally engaging the edge portion of the corresponding frame and securely retaining the frame within the groove against inadvertent removal therefrom; and (d) the grooves being offset from each other and positioning the frames inserted therein in a parallel and spaced disposition wherein the frames and mounting support collectively define a free standing vertical display assembly on a support surface.

2. The assembly of claim 1 wherein the means for frictionally engaging the frame includes at least one recess in the side wall and a rubber block disposed within the recess.

* * * * *